US005386859A

United States Patent [19]

Healy

[11] Patent Number: 5,386,859

[45] **Date of Patent: * Feb. 7, 1995**

[54] FUEL DISPENSING NOZZLE HAVING TRANSPARENT BOOT

[75] Inventor: James W. Healy, Hollis, N.H.

[73] Assignee: Healy Systems, Inc., Hudson, N.H.

[ * ] Notice: The portion of the term of this patent subsequent to Jul. 12, 2011 has been disclaimed.

[21] Appl. No.: 192,231

[22] Filed: Feb. 4, 1994

Related U.S. Application Data

[63] Continuation-in-part of Ser. No. 946,409, Sep. 16, 1992, Pat. No. 5,327,944, which is a continuation-in-part of Ser. No. 706,807, May 29, 1991, Pat. No. 5,174,346.

[51] Int. Cl.[6] ..... B67D 5/378

[52] U.S. Cl. ..... 141/59; 141/206

[58] Field of Search ..... 141/39–42, 141/44–47, 59, 206–229, 290, 301–305, 307, 308; 137/98, 100, 458, 459

[56] References Cited

U.S. PATENT DOCUMENTS

| | | | |
|---|---|---|---|
| 1,998,221 | 4/1935 | Conklin | 141/225 |
| 3,323,560 | 6/1967 | Ehlers | 141/208 |
| 3,542,092 | 11/1970 | Budzak et al. | 141/209 |
| 3,548,893 | 12/1970 | Moore | 141/208 |
| 3,638,689 | 2/1972 | Eklund | 141/214 |
| 3,763,901 | 10/1973 | Viland | 141/8 |
| 3,811,486 | 5/1974 | Wood | 141/208 |
| 3,815,327 | 6/1974 | Viland | 55/80 |
| 3,899,009 | 8/1975 | Taylor | 141/59 |
| 3,982,571 | 9/1976 | Fenton et al. | 141/225 |
| 4,056,131 | 11/1977 | Healy | 141/206 |
| 4,057,085 | 11/1977 | Shihabi | 141/59 |
| 4,057,086 | 11/1977 | Healy | 141/206 |
| 4,059,135 | 11/1977 | Hansel | 141/207 |
| 4,095,626 | 6/1978 | Healy | 141/206 |
| 4,121,635 | 10/1978 | Hansel | 141/207 |
| 4,133,355 | 1/1979 | Mayer | 141/217 |
| 4,258,760 | 3/1981 | Moore | 141/206 |
| 4,286,635 | 9/1981 | McMath | 141/98 |
| 4,336,830 | 6/1982 | Healy | 141/59 |
| 4,343,337 | 8/1982 | Healy | 141/226 |
| 4,372,353 | 2/1983 | Weas | 141/206 |
| 4,429,725 | 2/1984 | Walker et al. | 141/302 |
| 4,450,879 | 5/1984 | Wood | 141/209 |
| 4,497,350 | 2/1985 | Guertin | 141/206 |
| 4,809,753 | 3/1989 | Finc, Jr. | 141/206 |
| 5,147,328 | 9/1992 | Dragosits et al. | 604/218 |
| 5,213,142 | 5/1993 | Koch et al. | 141/59 |

FOREIGN PATENT DOCUMENTS

| | | | |
|---|---|---|---|
| 1097775 | 1/1961 | Germany | 141/226 |

*Primary Examiner*—J. Casimer Jacyna
*Attorney, Agent, or Firm*—Fish & Richardson

[57] ABSTRACT

Fuel dispensing nozzles, and vapor flow control assemblies useful with such nozzles, are constructed to maximize the possibility of collecting all of the hydrocarbon vapors displaced from the vehicle tank and upward through the fill pipe towards the atmospheric opening during filling of the tank with fuel. In one embodiment, the nozzle is provided with a boot of transparent polymeric material to facilitate positioning and enhanced recovery of fuel vapors displaced from the vehicle tank during delivery of fuel.

8 Claims, 9 Drawing Sheets

FUEL DISPENSING NOZZLE HAVING TRANSPARENT BOOT

BACKGROUND OF THE INVENTION

This application is a continuation-in-part of U.S. Ser. No. 07/946,409, filed Sep. 16, 1992, issued Jul. 12, 1994 as U.S. Pat. No. 5,327,944, which was a continuation-in-part of U.S. Ser. No. 07/706,807, filed May 29, 1991, issued Dec. 29, 1992 as U.S. Pat. No. 5,174,346. The invention relates to fuel dispensing nozzles, including those of the type described in my U.S. Pat. Nos. 4,056,131; 4,057,086; 4,343,337 and 5,174,346, and in my pending U.S. application Ser. No. 07/816,748, filed Jan. 2, 1992, and in particular to those fuel dispensing nozzles having the feature of vapor recovery, and to vapor flow control assemblies for use with such nozzles.

It is known to provide separate diaphragm assemblies for vapor regulation and high/low pressure sensing shutoff features. For example, Healy U.S. Pat. No. 4,056,131 describes a vapor handling arrangement in which a vapor regulator valve closes when excess vacuum is applied. A simple diaphragm has one side exposed to the atmosphere and the other side exposed to a vapor conduit. Excess vacuum in the conduit draws the diaphragm onto its seat to close the valve. A second diaphragm disposed above the first is exposed to the Venturi effect of the fuel being dispensed. The second diaphragm shuts down the vacuum by constraining the first diaphragm when fuel is not being dispensed.

Healy U.S. Pat. No. 4,057,086 describes a vapor handling nozzle with a diaphragm. When the end of the nozzle spout becomes immersed in fuel, e.g. indicating that the vehicle fuel tank is full, vacuum generated by the Venturi effect of fuel delivered through a constrained passageway in the nozzle causes the diaphragm and an associated plunger to move upward to interrupt fuel delivery. Also, when vapor pressure in the fuel tank exceeds a predetermined level, the diaphragm and plunger are caused to move downward to interrupt fuel delivery.

Healy U.S. Pat. No. 4,343,337 describes a fuel dispensing nozzle with a pair of diaphragms that operate to interrupt flow when conditions of over-pressure or under-pressure exist.

It is also known to provide a fuel dispensing nozzle that shuts off automatically when the tip of the spout is raised above its horizontal axis. One approach for achieve this objective is to provide an elongated chamber in the body of the nozzle, parallel with the horizontal axis of the nozzle. A ball is disposed inside the chamber and rolls backwards to actuate an automatic shutoff mechanism when the nozzle is raised above its horizontal axis.

SUMMARY OF THE INVENTION

According to a first aspect of the invention, a fuel dispensing nozzle for delivering fuel into a fuel tank by way of a fill pipe comprises a nozzle body, a spout housing, a spout extending from the spout housing, a fuel conduit defined by the nozzle and leading to the spout, a vapor conduit defined by the nozzle, the vapor conduit associated with the spout for withdrawing displaced vapors from the fuel tank being filled and transporting them to a remote vapor collection system, a fuel valve for controlling flow of fuel through the fuel conduit, and a boot disposed about the spout and having a first closed end and a second open end, the second open end defined by a rim disposed for sealing engagement with a surface about a fuel tank fill pipe when the spout is inserted therein, the boot having a body portion defining a volume for receiving fuel vapor displaced from a fuel tank during delivery of fuel, the volume in communication with the vapor conduit, the boot formed of a transparent polymeric material.

Preferred embodiments of this aspect of the invention may include vapor flow controlling means comprising a vapor flow control valve element disposed for movement within the vapor conduit relative to a valve seat defined by the conduit, and vapor flow control valve element positioning means comprising sealing means associated with the vapor flow control valve element, the sealing means having at least one surface exposed to fuel pressure in the fuel conduit.

Preferred embodiments of this and other aspects of the invention described below may include one or more of the following additional features. The transparent polymeric material of the boot comprises polyurethane. The durometer of the transparent polymeric material of the boot is 80 (Shore A).

According to another aspect of the invention, a fuel dispensing nozzle for delivering fuel into a fuel tank by way of a fill pipe comprises a nozzle body, a spout housing, a spout extending from the spout housing, a fuel conduit defined by the nozzle and leading to the spout, a vapor conduit defined by the nozzle, the vapor conduit associated with the spout for withdrawing displaced vapors from the fuel tank being filled and transporting them to a remote vapor collection system, a fuel valve for controlling flow of fuel through the fuel conduit, and a boot disposed about the spout and having a first closed end and a second open end, the second open end defined by a rim disposed for sealing engagement with a surface about a fuel tank fill pipe when the spout is inserted therein, the boot having a body portion defining a volume for receiving fuel vapor displaced from a fuel tank during delivery of fuel, the volume in communication with the vapor conduit. The body portion of the boot comprises a transparent polymeric material, and the fuel dispensing nozzle further comprises a vapor regulator valve in the vapor conduit operable in response to a predetermined first vapor pressure condition in the nozzle body, the vapor regulator valve comprising a diaphragm mounted in the nozzle with a first surface facing the vapor conduit, the diaphragm blocking the vapor conduit in a first position and not blocking the vapor conduit in a second position, and biasing means urging the diaphragm to the second position, the diaphragm having a second surface facing a chamber, the nozzle further defining a vent linking the chamber with the ambient exterior of the nozzle, and vapor flow controlling means comprising a vapor flow control valve element disposed for movement within the vapor conduit relative to a valve seat defined by the conduit, a vapor flow orifice between the vapor flow control valve element and the valve seat having an area variable with the position of the vapor flow control valve element, and vapor flow control valve element positioning means comprising sealing means associated with the vapor flow control valve element, the sealing means having at least one surface exposed to fuel pressure in the fuel conduit.

According to another aspect of the invention, a fuel dispensing nozzle for delivering fuel into a fuel tank by way of a fill pipe comprises a nozzle body, a spout housing, a spout extending from the spout housing, a fuel conduit defined by the nozzle and leading to the spout, a vapor conduit defined by the nozzle, the vapor conduit associated with the spout for withdrawing displaced vapors from the fuel tank being filled and transporting them to a remote vapor collection system, a fuel valve for controlling flow of fuel through the fuel conduit, and means for connection of the vapor conduit to a source of uniform vacuum, and a boot disposed about the spout and having a first closed end and a second open end, the second open end defined by a rim disposed for sealing engagement with a surface about a fuel tank fill pipe when the spout is inserted therein, the boot having a body portion defining a volume for receiving fuel vapor displaced from a fuel tank during delivery of fuel, the volume in communication with the vapor conduit. The body portion of the boot comprises a transparent polymeric material, and the fuel dispensing nozzle further comprises vapor flow controlling means comprising a vapor flow control valve element disposed for movement within the vapor conduit relative to a valve seat defined by the conduit, a vapor flow orifice between the vapor flow control valve element and the valve seat having an area variable with the position of the vapor flow control valve element, the control valve element having a generally tapering body with a first end diameter and a second end diameter relatively greater than the first end diameter, the control valve element oriented in the orifice with the first end diameter disposed upstream of the second end diameter, and the valve seat defined in a downstream region of the vapor flow orifice adjacent the second diameter end when the valve element is in closed position, and vapor flow control valve element positioning means comprising sealing means associated with the vapor flow control valve element, the sealing means having at least one surface exposed to fuel pressure in the fuel conduit.

According to another aspect of the invention, a method for delivering fuel into a fuel tank by way of a fill pipe comprises the steps of providing a fuel dispensing nozzle comprising a nozzle body, a spout housing, a spout extending from the spout housing, a fuel conduit defined by the nozzle and leading to the spout, a vapor conduit defined by the nozzle, the vapor conduit associated with the spout for withdrawing displaced vapors from the fuel tank being filled and transporting them to a remote vapor collection system, a fuel valve for controlling flow of fuel through the fuel conduit, and a boot disposed about the spout and having a first closed end and a second open end, the second open end defined by a rim disposed for sealing engagement with a surface about a fuel tank fill pipe when the spout is inserted therein, the boot having a body portion defining a volume for receiving fuel vapor displaced from a fuel tank during delivery of fuel, the volume in communication with the vapor conduit, the boot formed of a transparent polymeric material allowing the user to visually observe insertion of the spout into the closely fitting spout restriction (unleaded fuel only) of the fuel tank fill pipe of a vehicle, positioning the rim of the boot in locking engagement with a surface about the fuel tank fill pipe while observing the position of the spout and rim through the transparent material of the boot and adjusting the position of the spout and/or rim as necessary to maximize recovery of fuel vapor displaced from the fuel tank by delivery of fuel, actuating the fuel delivery nozzle to deliver fuel into the tank while recovery displaced fuel vapors, and visually observing through the transparent material of the boot to confirm, upon automatic shut-off, that the tank has been filled, rather than assuming incorrectly that the automatic shut-off has been actuated prematurely by fuel splashback, with the possible result, upon manual override, of over-filling of the tank and spillage of fuel.

Preferred embodiments of the method of the invention may include the further step of controlling vapor flow by providing a vapor flow control valve element disposed for movement within the vapor conduit relative to a valve seat defined by the conduit, and positioning the vapor flow control valve element by providing a seal associated with the vapor flow control valve element, the seal having at least one surface exposed to fuel pressure in the fuel conduit.

Other features and advantages of the invention will be seen from the following description of presently preferred embodiments, and from the claims.

DESCRIPTION OF THE PREFERRED EMBODIMENTS

Reference will be made throughout to my prior patents: U.S. Pat. No. 4,343,337 (issued Aug. 10, 1982); U.S. Pat. No. 4,056,131 (issued Nov. 1, 1977); U.S. Pat. No. 4,057,086 (issued Nov. 8, 1977) and U.S. Pat. No. 5,174,346 (issued Dec. 29, 1992).

A fuel dispensing nozzle of the invention is constructed for collection of fumes displaced from a tank by introduction of fuel, in a first embodiment (FIGS. 1 through 5A–5D) without use of an elongated boot extending along the spout and into sealing engagement about the tank fill pipe opening, as will be described in more detail below. In a second embodiment (FIGS. 6 and 7A–7C), an elongated boot of transparent material extends along the spout, the transparent material of the boot allowing the user to visually ensure sealing engagement of the boot about the vehicle fuel tank fill pipe opening for improved recovery of fuel vapors displaced from the fuel tank. This second embodiment is also described in more detail below.

Figure 1:
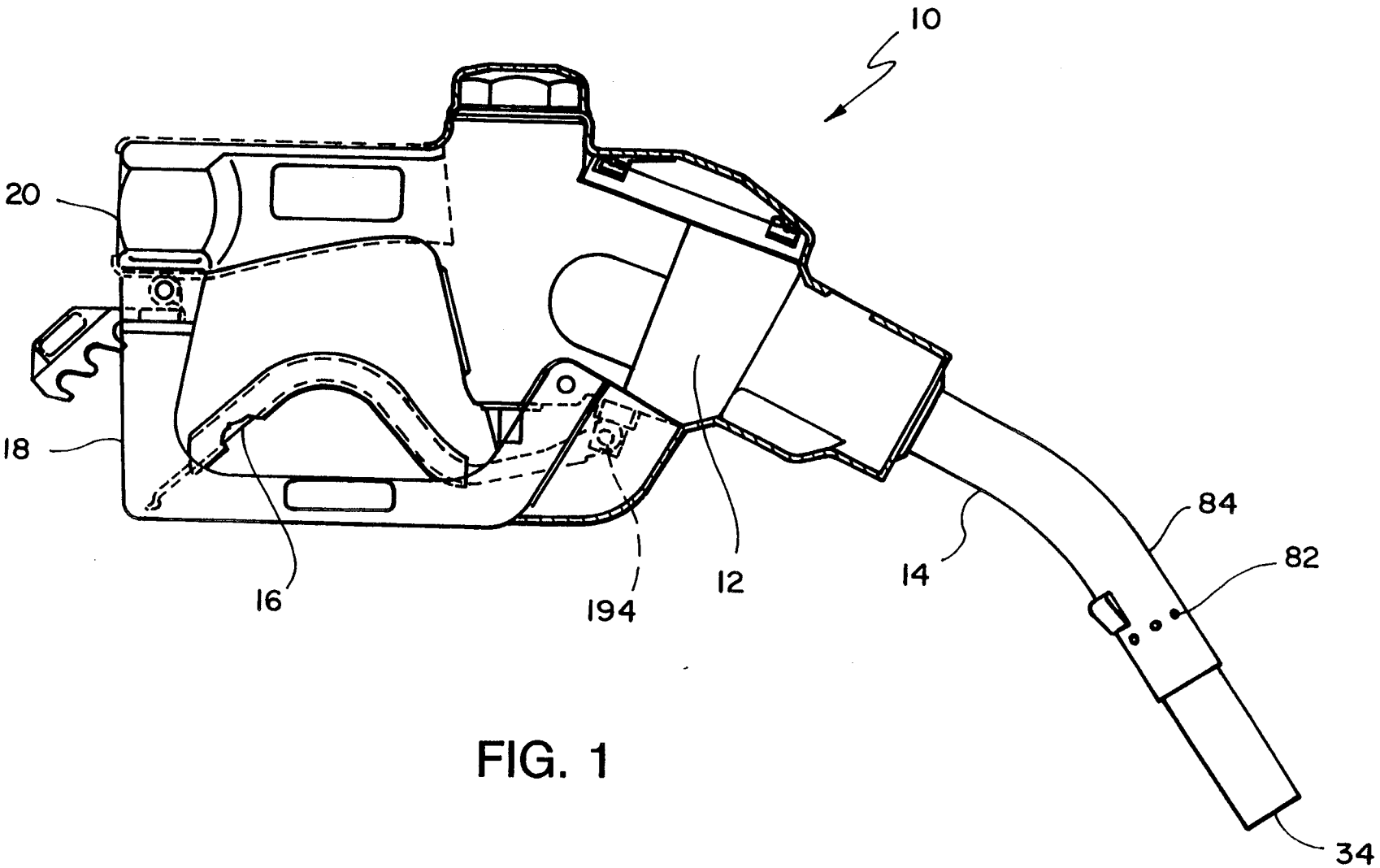
FIG. 1 is a side plan view of a fuel dispensing nozzle of the invention.

Referring to FIG. 1 of the present application, in a first embodiment, a fuel dispensing nozzle 10 consists of a nozzle body 12, formed, e.g., of aluminum, to which there is joined a spout assembly 14 (FIG. 2) for delivery of fuel into a vehicle tank (not shown). A lever assembly 16 for operation of nozzle is disposed beneath the nozzle body, within the region defined by hand guard 18. The body 12 of the fuel dispensing nozzle 10 is adapted for connection at 20 to a hose (not shown) defining a first conduit for connection of the nozzle to an external source of fuel and a second, typically coaxial conduit for connecting the nozzle to an external source of vacuum (not shown).

Figure 2:
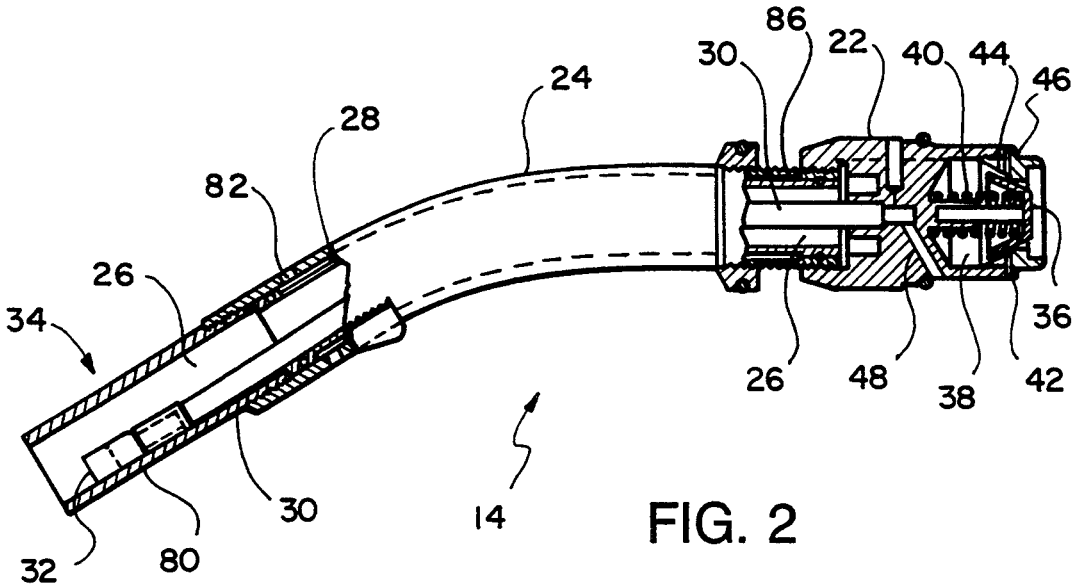
FIG. 2 is a side view, partially in section, of the spout assembly of the fuel dispensing nozzle of FIG. 1.

Referring now to FIG. 2, the spout assembly 14 includes a spout housing 22 and a spout tube 24 joined in threaded engagement, the spout tube 24 defining a pair of coaxial flow paths, a first flow path for dispensing of gasoline through a center passage 26 and a second counterflow outer passage 28 to contain returning hydrocarbon vapors. A vent tube 30, the function of which will be described below, extends within the conduit portion 26 defined by the spout tube 24, from a vent tube connector 32 adjacent the tip 34 of the spout tube to attachment at the spout housing 22. A check valve element 36 is disposed within the chamber portion 38 of the conduit 26 defined by the spout housing 22, urged by compression spring 40 into sealing engagement with a seat surface 42 supported by the spout housing in a manner to prevent drainage of fuel from the nozzle body and the attached hose when fuel delivery is remotely terminated. The fuel passage 44 defined by the check valve element 36 and the surrounding surfaces of the spout housing are configured in a manner to cause fuel flowing through the narrow passageway to create a Venturi effect in order to generate a vacuum that is drawn through vent passageway 46.

At its inner end, the vent conduit defined by the vent tube 30 connects to a vent passageway 48 defined by the spout housing 22, which in turn connects to vent passageway 50 (FIG. 4), which is defined by the nozzle body 12. Vent passageway 50 connects to passageway 74, which is defined by cover 62, and, within the cover, intersects cylindrical passageway 72 extending at an upward angle disposed at an angle M, e.g. approximately 15° to the axis S of spout housing 22, lying generally horizontal when the nozzle 10 is in its normal, predetermined position for filling a fuel tank. A spherical element 76 is disposed for movement within the cylindrical passageway 72, the outer end of which is accessed via a threaded set screw 78 for ease of maintenance. Passageway 72 is connected to the smaller coaxial passageway 52 which is intersected by passageway 54 leading to chamber 68. Chamber 68 is also connected to exit passageways 56 and 58 in the cover 62, which in turn connect to passageway 60 in the nozzle body 12. Passageway 60 is connected to exit passageway 46, which in turn terminates at fuel passage 44 in the region of check valve element 36, as described above. In this manner, a closed circuit is established for vacuum generated by the Venturi effect of fuel flowing through fuel passage 44 through passageways and chambers 46, 60, 58, 56, 68, 54, 52, 72, 74, 50, 48 and through vent tube 30 to inlet 80 of vent tube connector 32 at the end region of the spout 24 (i.e., an aspirator line).

Referring now again to FIGS. 2 and 3, the spout tube 24, at the discharge end 34, defines a plurality of holes 82 in the outer surface 84 of the spout tube 24 for passage of vapors into the outer conduit 28. The vapors, drawn by vacuum from the external vacuum source, travel the length of the spout and exit therefrom through a second circular group of holes 86 into the sealed internal chamber 88 of nozzle body 12. Chamber 88 in turn is in communication with passage 92, defined by the nozzle body 12.

Figure 5:
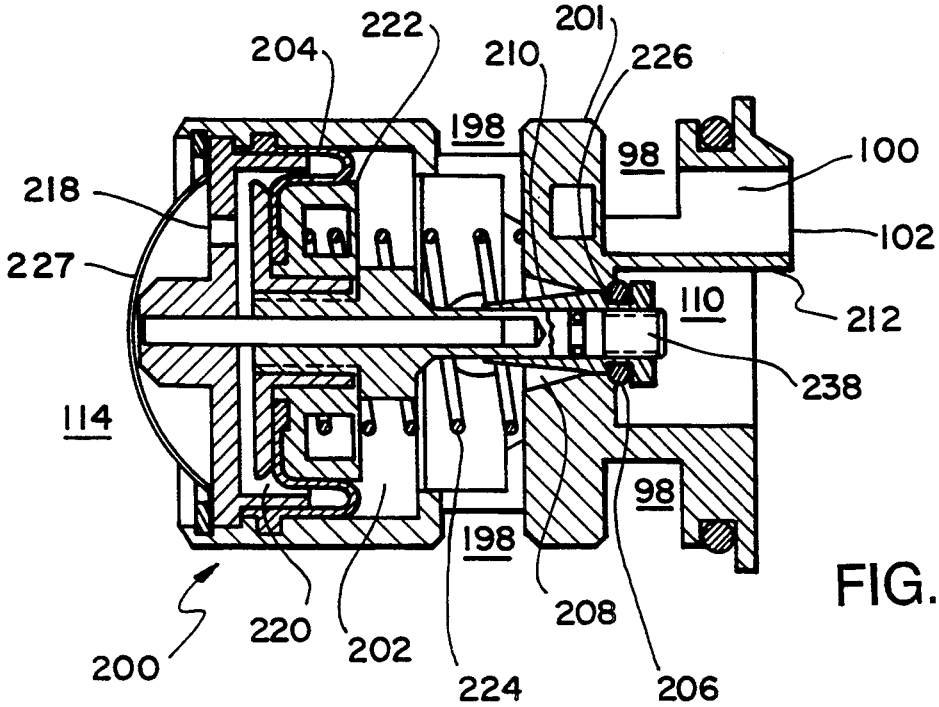
FIG. 5 is an enlarged cross sectional view of the vapor flow control valve assembly of FIGS. 5A and 5C showing the variable flow orifice.
Figure 5A:
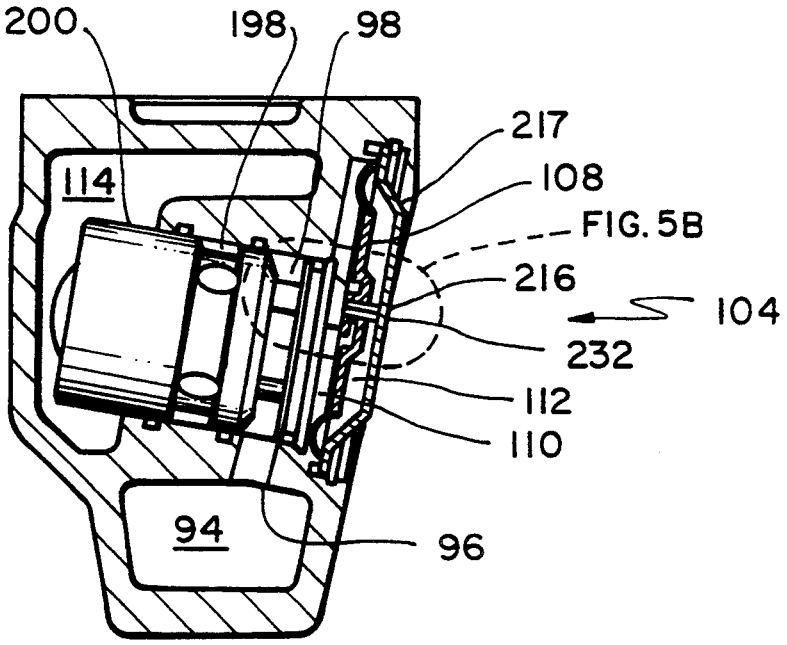
FIG. 5A is an enlarged end section view of the body of the fuel dispensing nozzle of FIG. 1 showing the vacuum pressure level regulator diaphragm assembly and adjusting stem.
Figure 5B:
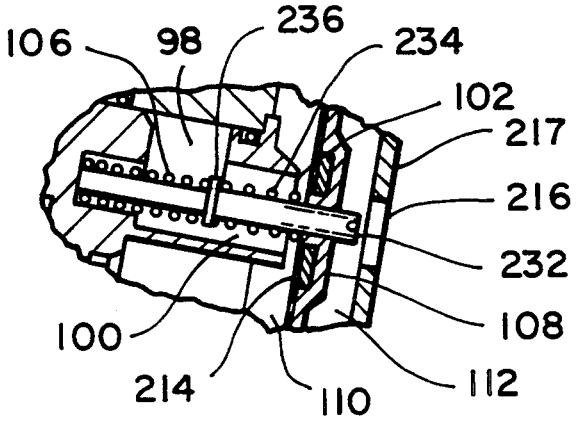
FIG. 5B is a further enlarged end section view of the vacuum pressure level regulator diaphragm assembly and adjusting stem, taken at the line 5B of FIG. 5A.

Referring now as well to FIGS. 5, 5A and 5B, for applications in which the level of vacuum provided by the central vacuum source is variable, e.g. where multiple fuel pumps are served by a single central source, in order to evacuate hydrocarbon vapor at a rate of flow essentially matching the rate at which gasoline is dispensed, the fuel dispensing nozzle 10 of the invention employs a combination of a vacuum pressure level regulator and a variable flow orifice.

The vacuum regulator function is described in detail in my U.S. Pat. No. 5,174,346.

Referring to the figure, a high vacuum source which may vary between −40 inches Water Column ("WC") and −120 inches WC is connected through nozzle passages 94, 96 (FIG. 3) to the circular groove 98 in housing 201. Groove 98 is intersected by passage 100 which has an open end 102 of approximately 0.210 inch diameter. The open end is closed by sealing contact of diaphragm assembly 104. Compression spring 106 urges diaphragm 108 away from sealing contact with passage 100 and will be compressed to the position shown in FIG. 5A when the vacuum level in chamber 110 is approximately −15 inches WC. Atmospheric pressure in chamber 112 will overcome the force of compression spring 106, thus closing off passage 100 whenever the pressure differential across the diaphragm 108 is 15 inches WC or greater.

Figure 3:
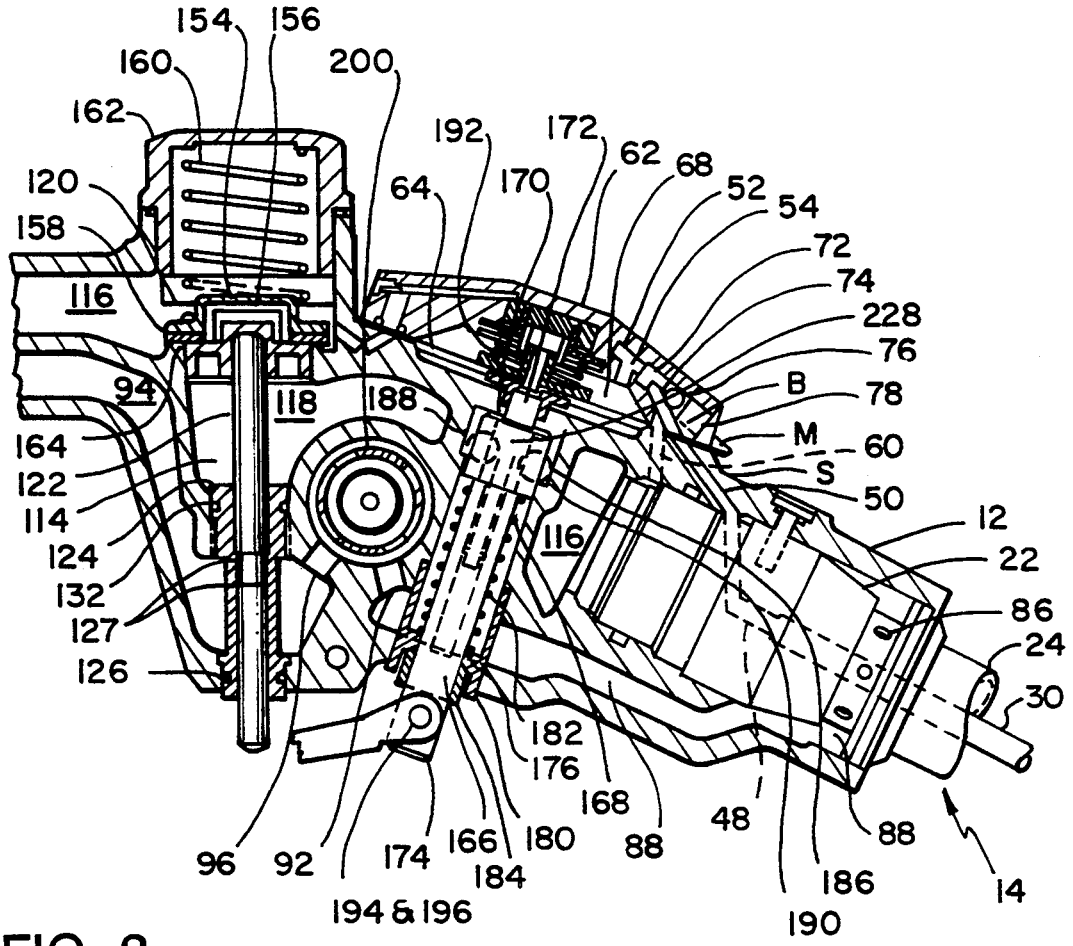
FIG. 3 is a side view, partially in section, of the fuel dispensing nozzle of FIG. 1.
Figure 4:
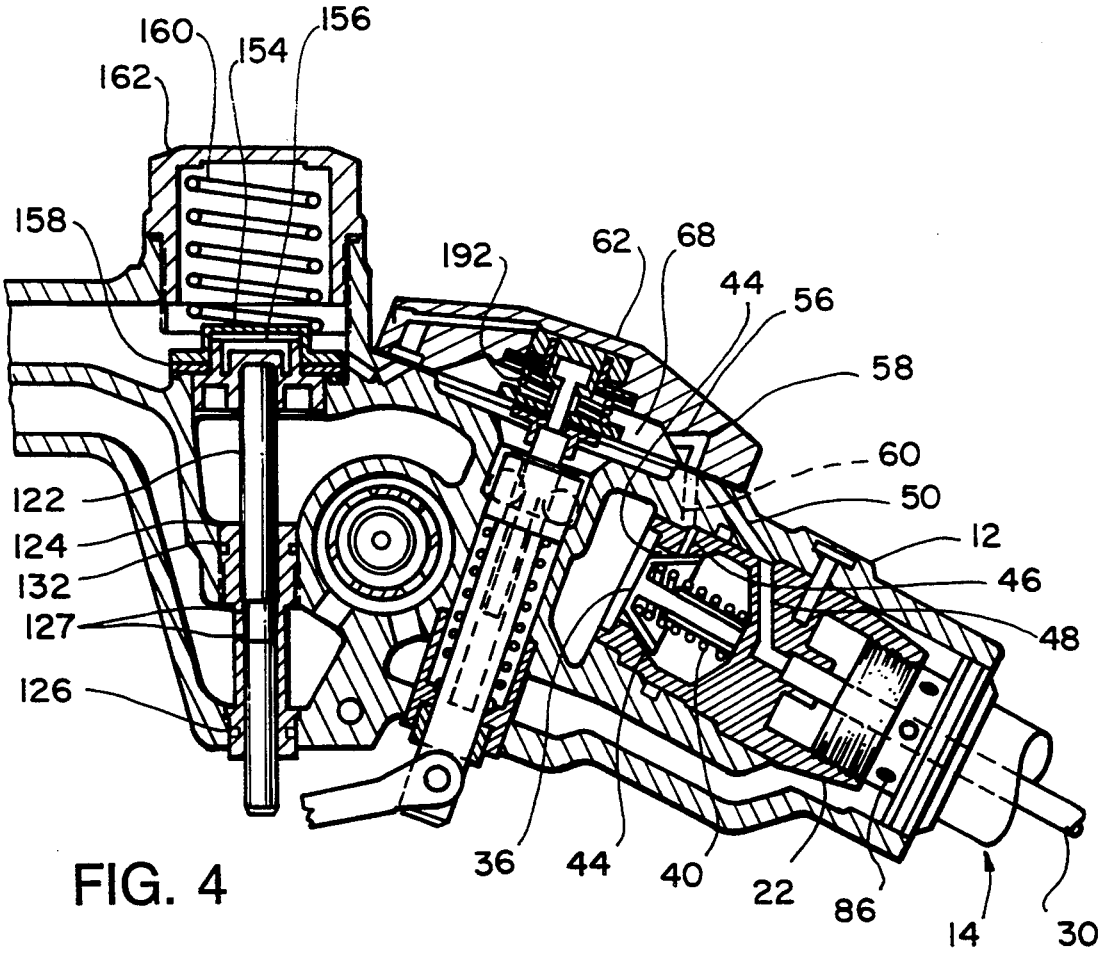
FIG. 4 is a similar side sectional view of the fuel dispensing nozzle of FIG. 1.

Referring to FIGS. 3, 5 and 5A, the nozzle body 12 defines passageway 114 for delivery of fuel received via the fuel line 116 from the hose. When the nozzle is actuated, fuel passes through valve opening 118, and then via passageways 114, 116 to the spout assembly 14. As described above, and with reference to FIG. 2, the fuel passes through passageway 44 between the check valve element 36 and the surrounding wall of the spout housing 22 defining the seat 42, to create a vacuum in passageway 46. The fuel travels through chamber 38 and then via conduit 26 of the spout tube 24 to be delivered in the vehicle fuel tank.

Referring again to FIG. 3, the main valve assembly 120 consists of a valve stem 122 mounted for axial movement within the nozzle body relative to the fixedly mounted stem seal body 124. The stem seal body 124 is disposed in threaded engagement with the nozzle body and defines an axial opening through which the valve stem 122 extends. Liquid tight seal between the valve stem 122 and the stem seal body 124 is maintained by means of o-ring seals 127. Vacuum tight seal between the stem seal body 124 and the nozzle body 12 is facilitated by o-rings 126 and 132.

The main fuel valve assembly 120 is mounted upon the upper end of valve stem 122, and includes a main valve cap 154 and a poppet skirt 156. A main valve seal 158 is disposed between the cap 154 and skirt 156, and main spring 160, held in place by body cap 162, bears upon the valve cap 154 in a manner to maintain the seal 158 in sealing engagement upon valve seat 164 defined by the nozzle body 12.

Referring still to FIG. 3, plunger 166 disposed in passageway 168 has an enlarged plunger head 170 surrounding latch pin 172 attached to diaphragm assembly 64, and an outer end 174 which extends through orifice 176 in sleeve 180 which is epoxy sealed on its threaded engagement with nozzle body 12. A plunger latch spring 182 is disposed between the sleeve 180 and the enlarged head portion 170 of plunger 166. A spacer 184 is disposed about the lower end 174 of the plunger 166, external of the nozzle body. Three balls 186 are disposed in the chamber 188 defined about the plunger head portion 170, maintained in the position shown in the figure by means of latch ring 190 and latch pin 172. The position of the plunger 166 and the diaphragm assembly 64 at rest are further maintained by diaphragm spring 192 disposed in chamber 68 between the diaphragm 64 and cover 62. Referring also to FIG. 1, the lever assembly 16 for actuation of the nozzle (described below) is pivotally connected to the end 174 of the plunger 166 by means of lever pin 194 disposed in plunger end orifice 196.

Referring now again to FIG. 1 et seq., for dispensing fuel, the spout 14 of a fuel dispensing nozzle 10 of the invention is inserted into the fill pipe of a vehicle fuel tank. Unlike prior art fuel dispensing nozzles, the nozzle 10 of the invention is constructed for collection of displaced fuel vapors without requiring use of an extended boot that must be brought into sealing contact with the vehicle fill pipe, and must further be inspected, and frequently repaired or replaced, for rips or tears that result in escape of fuel vapor.

The fuel dispensing nozzle 10 of the invention is actuated by moving operating lever 16 toward the nozzle housing 12, causing the inner end of the lever to pivot about lever pin 194 in the end orifice 196 in the end 174 of plunger 166. The lever 16 engages the exposed end of the valve stem 122, raising the stem to make contact with the fuel valve 120. As further pressure is applied to lever 16, the compression force of spring 160 is overcome, and fuel valve 120 is opened to allow fuel to flow from a remote fuel pump (not shown) through the passageways 116, 114, et seq., to exit from the spout 24 via conduit 26.

As fuel enters passage 114 within the nozzle body 12, the pressure will rise from 0 psi to approximately 2.5 psi before the Venturi check valve 36 will open. The increase of pressure in passage 114, which is in communication with passage 218 and chamber 220, will cause the vapor valve 210 to open the vacuum source for vapor removal when the fuel pressure exceeds the compressive force of spring 224 by unsealing o-ring 206. When fuel is delivered from spout 24 into a vehicle tank, vapors displaced from the vehicle fuel tank are drawn into the spout tube by way of holes 82 and pass through co-axial passageway 28 to exit via holes 86 into chamber 88 defined by the nozzle body 12. Hydrocarbon vapors from the spout assembly 14 continue through passage 92 which is in open communication with the circular groove 198 in housing 201 of vapor vacuum regulator 200. Groove 198 is drilled through radially inward to intersect chamber 202 in housing 200 at least one location. Chamber 202 is sealed by a rolling diaphragm 204 at one end, and by an o-ring 206 at the opposite end. Hydrocarbon vapor from chamber 202 may flow into chamber 110 whenever the o-ring 206 is moved from sealing contact with housing 200 thus permitting vapor flow through orifice 208. During vapor flow, the vacuum level in chamber 110 is maintained by the action of diaphragm assembly 108 in variable proximity to the open end 102 of passage 100. The rate at which hydrocarbon vapors flow into chamber 110 is a function of the position of the conically-shaped valve 210 in orifice 208. The position of valve 210 is a function of the liquid gasoline pressure within the nozzle body 12 at chamber 114.

Vapor from chamber 202 is drawn via orifice passageway 208 into chamber 110, which is defined in part by wall 212 (defining vapor passage 100) and diaphragm 108. Diaphragm 108, upon which there is mounted a disk 214 of closed cell, gas resistant foam material, disposed for sealing engagement with the opening 102 with wall 212, is biased to the position shown by atmospheric pressure in chamber 112 overcoming compression spring 106. When pressure within chamber 110 is reduced to 15 inches WC below atmospheric pressure by the action of the remote vacuum pump, the pressure differential between chamber 110 and chamber 112, which is open to the atmosphere via port 216 in cover 217, will cause diaphragm 108 to overcome the resisting force of compression spring 106 and engage disk 214 upon the top surface of wall 212, thus closing off the vapor passage 100. When the vapor pressure rises back towards atmospheric pressure, the diaphragm 108 moves away from the opening 102 of vapor passage 100 as shown in FIG. 5B and allows vapor to be once again evacuated from chamber 110 thus maintaining the vacuum level at approximately 15 inches WC. The vapor is drawn from chamber 110 via the opening 102 into passage 100, circular groove 98 and then into passageway 96. When the orifice 102 is open to chamber 110, the remote vacuum pump will draw vapor through passages 100, 98, 96, and then upward into passageway 94 within the nozzle handle, and then finally into a central conduit of the coaxial hose assembly (not shown).

Referring again to FIG. 5, gasoline pressure in chamber 114 is essentially at 0 psi when the nozzle is in the off condition. When the main valve 120 is open, pressure in chamber 114 increases to the cracking pressure of the check valve (36, FIGS. 2 and 3) and varies upwardly depending on the flow rate of gasoline. A typical pressure would be 3 psi at 2 gpm flow, and increasing in a nearly linear fashion to 12 psi at 10 gpm flow.

The gasoline pressure in chamber 114 causes gasoline to flow through filter screen 227 and opening 218 into chamber 220, thus producing a force against the piston 222 and the attached rolling diaphragm 204. Movement of the piston 222 is resisted by compression spring 224, which is designed to hold o-ring 206 in sealing contact with the valve seat 226 defined by the housing 200 until the gasoline pressure reaches 2 psi. The vapor return pathway between the spout assembly 14 and the external vacuum source is therefore positively sealed unless the main valve 120 has been opened to permit gasoline flow and there is fuel pressure available in the hose to produce sustained flow.

The spring rate of spring 224 is selected to produce approximately 0.30 inch of deflection when the pressure in chamber 114 reaches 12 psi. The vapor flow control is achieved by variations in the diameter of the valve cone 210 in relation to the valve travel produced by the pressure of gasoline in chamber 114. By combining the known pressure versus flow characteristics for the vapor vacuum regulator 200 and that of the spout assembly 14 plus nozzle body vapor path to the chamber 202 in housing 201, variable diameters can be selected for the valve cone 210 to provide the correct throttling action across orifice 208.

Adjusting the valve cone 210 is accomplished by rotating the valve on its threaded engagement with valve stem 238. Rotation in one direction will draw in the valve stem 238 and the attached piston 222, thus increasing the compressive force of the spring 224. This will result in a higher pressure level in chamber 114, and therefore a higher fuel flow condition for a given vapor flow condition. Rotation of the valve in the opposite direction will match a decreased fuel flow with the given vapor flow condition.

In this manner, the vapor flow returning to the underground storage tank ullage space can be matched to the rate of flow of liquid gasoline drawn from the underground tank.

The object of the invention is, of course, to maximize the possibility of collecting all of the hydrocarbon vapors as they move out of the vehicle tank and upward through the fill pipe towards the atmospheric opening. This can be achieved by a precisely-matched flow arrangement. If the vapor removal rate is lower than the outflow, the uncollected vapors will be emitted to the atmosphere at the fill pipe opening. If the vapor removal rate is higher than the actual vapor flow rate, air will be drawn into the fill pipe and returned with the hydrocarbon vapors to the underground storage tank. This excess volume of air/hydrocarbon will result in vapor emissions from the tank vent. Both of these conditions have a tendency to reduce overall vapor recovery efficiency.

In order to more exactly match vapor flow to fuel flow, the adjusting stem 232 is in threaded engagement with the diaphragm 108 to enable the nozzle user to increase or decrease the amount of compression on regulator spring 106. Increasing the compression will result in a higher regulated vacuum level (e.g., 16 inches WC) thus increasing the vapor flow across the variable annulus between orifice 208 and valve 210. Decreasing the spring force will have the opposite effect. A compression spring 234 is installed between the adjusting stem flange 236 and the diaphragm 108. Spring 234 is very stiff in comparison to the regulator spring 106, and thus prevents any relative angular movement between the stem and the diaphragm after manual adjustment.

Referring again to FIG. 3, nozzle shut-off is accomplished by vacuum acting on diaphragm 64 which acts to overcome the downward force of spring 192 and the frictional drag of the stainless steel balls 186 against the pin 228 at a vacuum of approximately 25 inches WC (see, e.g., U.S. Pat. No. 4,343,337, col. 4, line 58 through col. 5, line 2).

Referring again to FIG. 3, if the vent circuit is blocked, e.g. by presence of the spherical element 76 at the intersection of bore 72 with passageway 52 (as described more fully below) or a full tank condition in which fuel is present at the inlet 80 of connector 32, fuel nonetheless continues to flow into the nozzle and the vacuum pressure in the chamber 68 increases rapidly. In response, the diaphragm 64 moves upwardly, overcoming the downward force of spring 192, and also drawing pin 228 upwardly. As the pin is moved upward, the wider upper portion of the pin is removed from adjacent balls 186, leaving the narrower, lower portion of the pin adjacent the position of the balls. This permits the balls 186 to pass downward, by the latch ring 190, releasing the plunger 166 to move downwardly and release the end of lever 16. Since the lever 16 no longer holds the valve stem 122 in place, spring 160 forces the valve stem downward and closes the fuel valve 120, thereby shutting off the nozzle.

Also, in nozzles of prior known design, a check valve mechanism is provided in the body of the nozzle, relatively remote from the spout outlet. When the check valve mechanism is triggered, a significant volume of fuel is contained within the nozzle. As a result, if the nozzle is not tipped forward into the fuel tank to drain the residual fuel from the nozzle, the residual fuel may be spilled when the end of the nozzle is removed from the vehicle fill pipe, thus damaging the vehicle finish, creating a danger of explosion, and polluting the environment. In the fuel dispensing nozzle 10 of the invention, in order to reduce the amount of fuel that might accidentally be dispensed from the nozzle, there is provided an improved flow stop mechanism. Referring to FIG. 3, the cover 62 defines a further cylindrical passageway 72 co-axial with smaller passageway 52 and extending at an upward angle disposed at an angle M, e.g. approximately 15°, to the horizontal axis S of the spout housing 22, lying generally horizontal when the nozzle 10 is in its normal, predetermined position for filling a fuel tank. The location of this function in the cover assembly creates several advantages over the typical spout tip mounted designs. The cover location permits a substantial difference in the angle of the ball track from that of the cylindrical discharge end 34 of the spout. This freedom allows the spout to be fabricated in accordance with ISO ("International Standards Organization") standards while permitting the ball track angle to be selected to insure a shut-off function at or before the spout tip centerline reaches horizontal. This latitude allows compensation for rolling friction, and for ball surface stiction. The spherical element 76 is sized relative to the diameter of passageway 72 so that it readily rolls when the axial orientation of the spout housing 22 is changed, and is further sized so that when the element is lodged at the intersection of passageway 72 with passageway 52, vacuum flow is interrupted. When the nozzle 10 is disposed in an orientation for dispensing fuel, e.g. with the angle the spout housing axis S approximately horizontal, the spherical element 76 is disposed toward the sealing element, i.e. threaded set screw 78, away from the intersection with passageway 52, and the vacuum passageway is unobstructed. However, when the nozzle is reoriented to a position in which the angle of the axis B of the passageway 72 is greater than 0° to the horizontal, e.g., when the nozzle is carried upright to the fuel tank or hung on the fuel pump, gravity causes the spherical element 76 to roll into the intersection with passageway 52, blocking vacuum flow, thereby simulating a fuel tank full condition and thus cause the fuel dispensing nozzle to discontinue fuel flow by raising the level of vacuum in chamber 64, as described above. When the nozzle 10 is returned towards its original orientation, i.e. with axis B inclined downward at an angle greater than 0° to the horizontal, the element 76 rolls away from the passageway intersection, thus allowing reestablishment of flow in order to reduce the level of vacuum in chamber 68 to below a predetermined maximum level.

Another embodiment of the invention has particular application for situations in which the external vacuum pressure source, e.g. a constant vacuum level vane pump, provides a relatively constant level of vacuum, thus making it unnecessary to provide means for regulation of vacuum pressure within the nozzle.

Figure 5C:
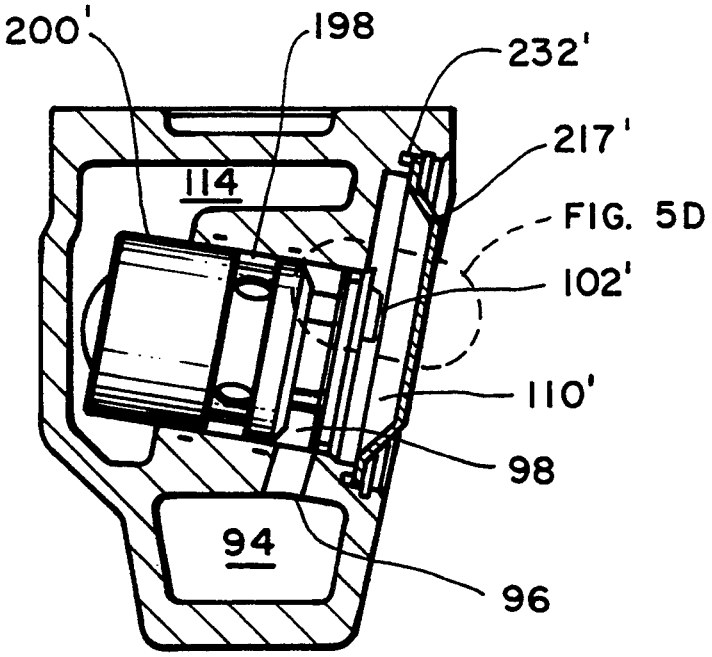
FIG. 5C is an enlarged view similar to that of FIG. 5A of another embodiment of the fuel dispensing nozzle of the invention, e.g. for use with a constant vacuum source.
Figure 5D:
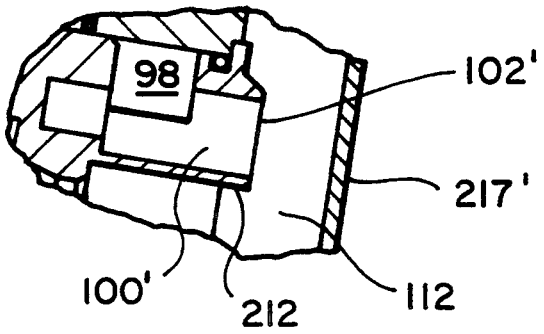
FIG. 5D is a further enlarged end section view of the vacuum flow arrangement, taken at the line 5D of FIG. 5C.

Referring now to FIG. 5C, in vapor vacuum regulator 200', a single chamber 110' is defined beneath the cover 217', which is sealed about its periphery by o-ring 232'. The end 102' of vapor passageway 100' is open to connect chamber 110' with passageway 98.

Figure 6:
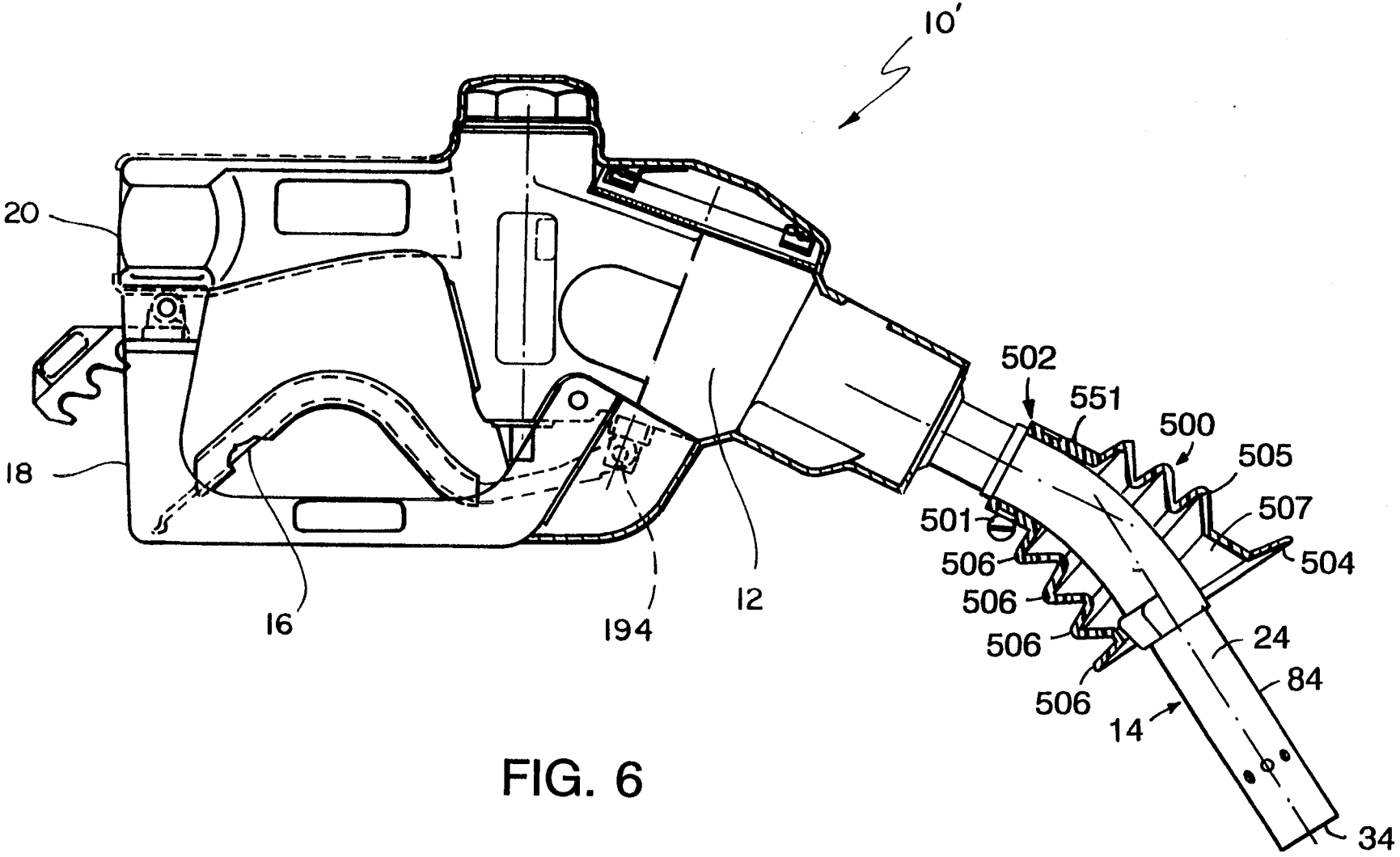
FIG. 6 is a side plan view of a fuel dispensing nozzle with a transparent boot of the invention.

In the second embodiment of the invention, a fuel dispensing nozzle 10', e.g., of the type described above with respect to FIG. 1 et seq., is equipped with a transparent, axially-resilient boot 500, as shown in FIG. 6. The transparent boot is removably secured, e.g. with a pipe clamp 501, about the outer surface 84 of an outer portion 502 of the spout assembly 14 and extends along the spout tube 24, toward the spout tip 34. When the spout tip is inserted into the fuel tank fill pipe, outer lip 504 of the transparent boot 500 engages in sealing relationship with the surface about the fuel tank fill pipe opening, proper positioning being facilitated by the transparent nature of the boot material. The boot thus serves to further resist escape of fuel vapors displaced from the fuel tank for collection by the vapor recovery system described above.

The body portion 505 of the boot 500, which defines a volume 507 for collection of displaced fuel vapors, has ridged folds 506 which compress resiliently when the lip 504 is pressed against the surface about the fill pipe opening to increase the sealing pressure and further resist escape of displaced fuel vapors from within the volume 507, before recovery by the vapor recovery system. Since the material of the boot .is transparent, a user can also more easily ensure proper positioning of the spout assembly during fuel delivery.

Figure 7A:
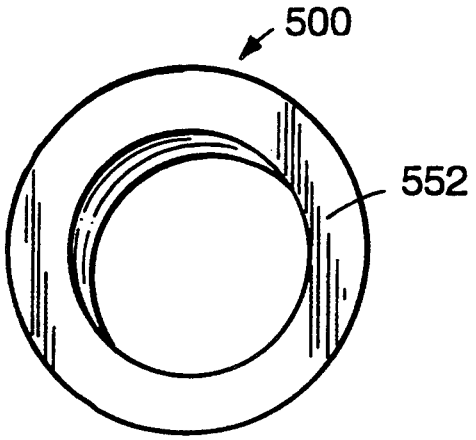
FIGS. 7A, 7B and 7C are front, side and rear views, respectively, of the transparent boot of FIG. 8.
Figure 7B:
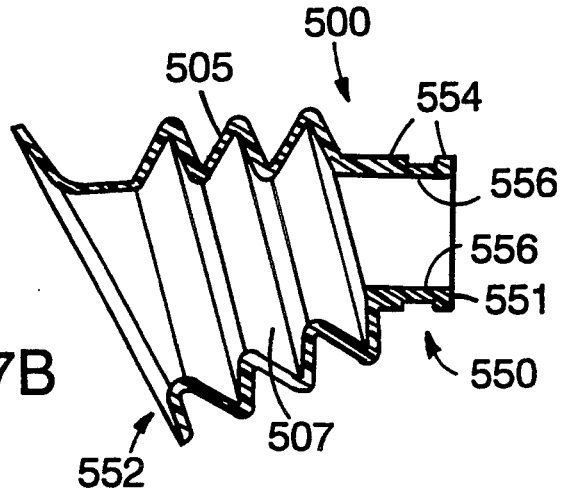
Figure 7C:
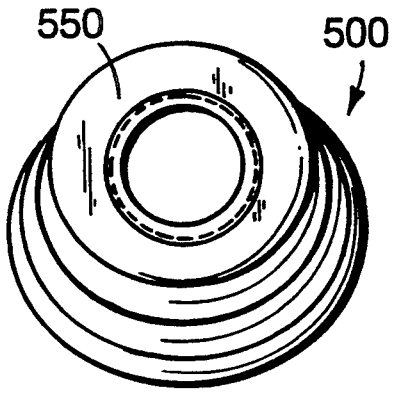

Referring also to FIGS. 7A through 7C, an upper end 550 of the boot 500 has the form of a sleeve 551 with a circular cross-section sized to fit snugly about the fuel dispensing nozzle spout. The body portion 505 extends from the sleeve with a curvature generally conforming to the curvature of the spout. The body portion 505 of the boot has a wall thickness of about 0.075 inch. The thickness of the sleeve 551 in regions 554 is about 0.125 inch; in the region of groove 556 provided to receive the clamp 501 the wall thickness is about 0.09 inch.

The boot 500 is formed of a suitable transparent polymeric material, e.g. polyurethane, selected for resistance to gasoline, ozone and ultraviolet radiation. The characteristics of resilience and flexibility at low temperatures (e.g., in a preferred embodiment, the material has a durometer of 80 (Shore A), and it is sufficiently flexible to provide an acceptable seal with a range of fuel tank fill pipe configurations), durability, tear-resistance and sturdiness are also desirable.

In use, a boot 500 of the invention, formed of a transparent polymeric material, allows the user to visually observe insertion of the spout tip 34, e.g., into the closely fitting spout restriction (unleaded fuel only) of the fuel tank fill pipe of a vehicle. It also facilitates positioning the rim 504 of the boot in locking engagement with a surface about the fuel tank fill pipe, while observing the position of the spout and rim through the transparent material of the boot and adjusting the position of the spout and/or rim as necessary to maximize recovery of fuel vapor displaced from the fuel tank by delivery of fuel. Furthermore, when the automatic shut-off mechanism (described above) is actuated by presence of fuel at the spout tip, the transparent material of the boot allows the user to differentiate between a first condition when the automatic shut-off mechanism has been prematurely actuated by fuel splashback, in which case it is safe to over-ride the automatic shut-off mechanism manually to complete the tank filling process, and a second condition when the automatic shut-off is actuated by a full tank. An incorrect assumption of the first condition,, caused, e.g., by inattention or erroneous estimation by the user of the amount of fuel in the tank, without the ability for visual confirmation (except by removal of the spout from the fill-pipe) has often resulted in over-filling of the vehicle tank with spillage of fuel and damage to the environment. The transparent material of the boot 500 of the present invention can reduce the instances of over-filling by allowing the user to visually observe the delivery of fuel into the fill-pipe, and thus confirm when the automatic shut-off mechanism is properly triggered by a full tank.

Another embodiment of the invention has particular application for use with the nozzle shown in FIG. 3 with the variation that passageway 92 connects directly with passageway 96, thus eliminating both the vapor flow regulator 200 and the vapor pressure regulator diaphragm 108 and associated spring and cover. This nozzle variation requires an external vacuum pressure source, e.g. a constant vacuum level vane pump, providing a relatively constant level of vacuum, thus making it unnecessary to provide means for regulation of vacuum pressure within the nozzle. The vapor flow regulation means within the nozzle is also eliminated by use of the mechanism shown in FIG. 8.

Figure 8:
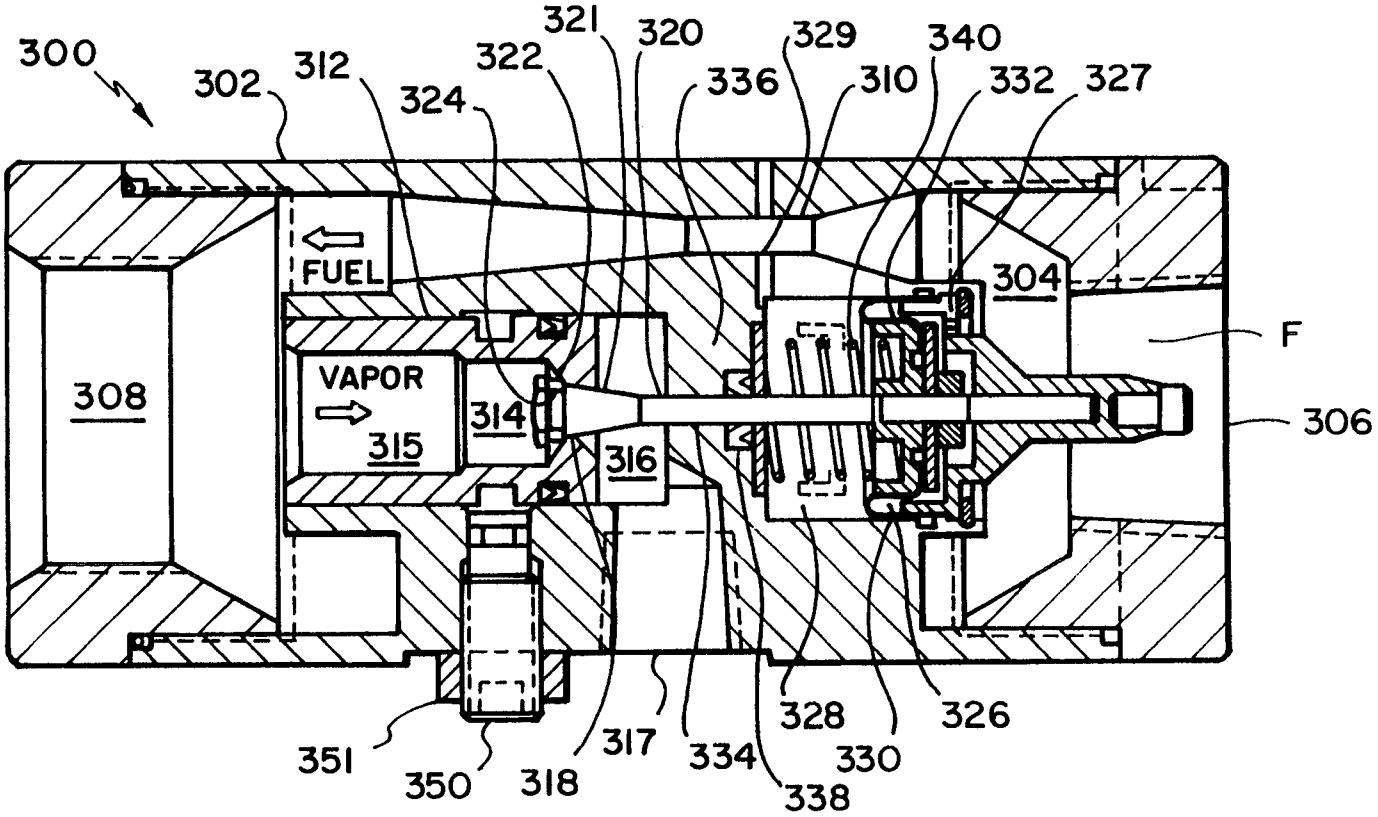
FIGS. 8 and 9 are enlarged end section views of other embodiments of a fuel dispensing system with a vapor flow control device of the invention.

Referring now to FIG. 8, a vapor flow control device 300 of the invention has a body 302 defining a conduit 304 for passage of fuel from an external source toward the fuel dispensing nozzle (arrow F), with an inlet end 306 and an outlet end 308, both threaded for connection of the fuel hose section. The conduit 304 has a narrow waist section 310 which creates a localized reduction in fuel pressure.

The vapor flow control device 300 further has a body 302 with first and second vapor flow chambers 314, 316, connected by a vapor flow orifice 318. The first vapor flow chamber 314 defines an inlet 315 which provides for an o-ring connection to a coaxial hose from the fuel dispensing nozzle (not shown). The second vapor flow chamber 316 defines an outlet 317 which is threaded for connected to a hose to the constant vacuum level vane pump (not shown). A vapor flow regulator valve 320 has a conically-shaped head element 321 disposed in the orifice 318, the head element including o-ring 322 mounted for sealing engagement upon valve seat 324 to prevent vapor flow between the first and second vapor flow chambers. The housing 312 further has first and second fuel chambers 326, 328 which are separated by a rolling diaphragm 330. The first fuel chamber 326 is connected by conduit 327 to the high pressure region of fuel conduit 304. The second fuel chamber 328 is connected by conduit 329 to the low pressure region of fuel conduit 304. Attached to the diaphragm 330 is a piston 332, upon which there is mounted the vapor flow control valve 320. The valve 320 extends through an orifice 334 in the wall 336 between the second fuel chamber 328 and the second vapor flow chamber 316, the orifice being sealed by u-cup 338. A compression spring 340 disposed within the second fuel chamber 328 urges the piston toward the position shown, with the o-ring 322 in sealing engagement between the vapor flow chambers. When the differential of pressure between the first and second fuel chambers 326, 328 exceeds a predetermined level, the compression force of spring 340 is overcome and the valve element 321 is displaced from sealing engagement to allow vacuum flow from the nozzle. As in the first embodiment described above, the configuration of the conically-shaped valve head element 321 is selected to vary the size of the orifice 318 in relationship to the difference in the pressure of the fuel in the conduit 304 and the reduced cross-section of narrow waist section 310.

Again, in the manner described, the vapor flow returning to the underground storage tank can be matched to the rate of flow of fuel drawn from the storage tank for delivery, e.g. through an existing fuel dispensing nozzle or through a nozzle connected to a constant source of vacuum. As a result, the possibility of collecting all of the hydrocarbon vapors as they move out of the vehicle tank and upward through the fill pipe towards the atmospheric opening is maximized by a precisely-matched flow arrangement. Flow adjusting eccentric screw 350 provides means to vary the position of housing 312 along the centerline. Movement of the housing 312 resulting in further compression of spring 340 will reduce the amount of vapor flow related to a given fuel flow by requiring a larger pressure differential in conduit 304 to create the same annular opening between the orifice 318 and valve cone 321. Movement of housing 312 in the opposite direction will result in an increase in vapor flow in relation to a given fuel flow. When the adjustment is complete, jam nut 351 is tightened to maintain the setting.

Still another embodiment of the invention also has particular application for use with the nozzle shown in FIG. 3, also with the variation that passageway 92 connects directly with passageway 96, thus eliminating both the vapor flow regulator 200 and the vapor pressure regulator diaphragm 108 and associated spring and cover. As described above with reference to FIG. 3, this further nozzle variation also requires an external vacuum pressure source providing a relatively constant level of vacuum, thus making it unnecessary to provide means for regulation of vacuum pressure within the nozzle. The vapor flow regulation means within the nozzle is also eliminated by use of the mechanism shown in FIG. 9, as will now be described.

Figure 9:
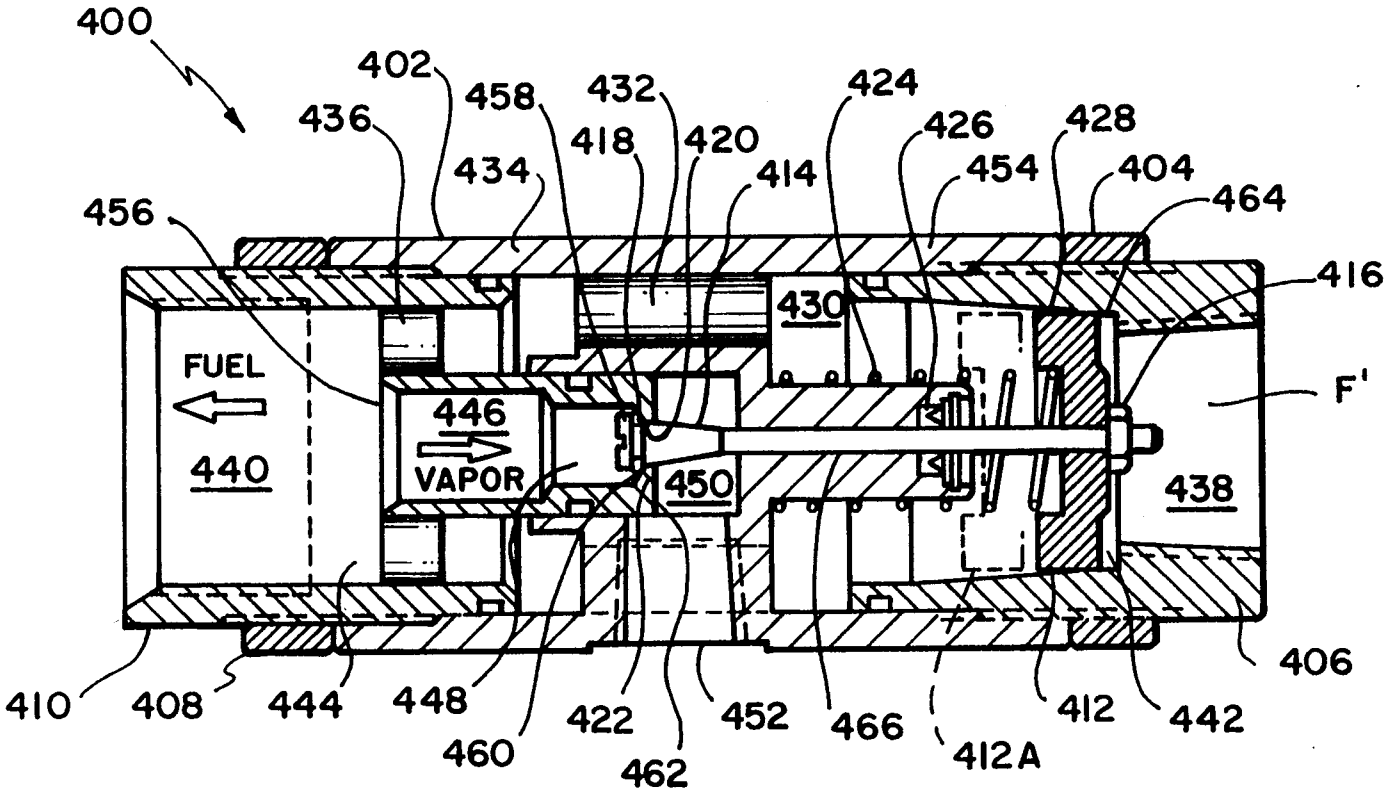

Referring now to FIG. 9, a vapor flow control device 400 of the invention defines a conduit for passage of fuel from an external source toward the fuel dispensing nozzle (arrow F'), with an inlet end 438 and an outlet end 440, both threaded for connection of the fuel hose section (not shown). The fuel conduit consists of sequential passageways and chambers 438, 442, 428, 430, 432, 434, 436, 444 and 440.

The vapor flow control device 400 further has a housing 454 with first and second vapor flow chambers 446 and 448, leading to a vapor flow orifice 420. The first vapor flow chamber 446 defines an inlet 456 which provides for an o-ring-sealed connection (not shown) to a hose from the fuel dispensing nozzle.

A third vapor flow chamber 450 leads to outlet 452 which is threaded for connection to a hose to the constant vacuum level vane pump (not shown). A vapor flow regulator valve 458 has a conically-shaped head element 414 disposed in the orifice 420, defined by surface 422, the head element including o-ring 418 mounted for sealing engagement upon valve seat 460 to prevent vapor flow between the second and third vapor flow chambers. The device 400 further has first and second fuel chambers 442 and 430 which are separated by a piston 412. The first fuel chamber 442 is connected by passage 428 to the second fuel chamber 430. The vapor flow regulator valve 458 and the piston 412 are attached together (with the piston secured upon extension 466 of valve 458 by nut 416) and movable in response to fuel flow. The valve 458 extends through the orifice 420 in the wall 462 between the second vapor flow chamber 448 and the third vapor flow chamber 450, the orifice being sealed by o-ring 418. A compression spring 424 disposed within the second fuel chamber 430 urges the piston toward the position shown, with the o-ring 418 in sealing engagement between the vapor flow chambers. When the differential of pressure between the first and second fuel chambers 442, 430 exceeds a predetermined level, the compression force of spring 424 is overcome and the valve element 458 is displaced from sealing engagement to allow vacuum flow from the nozzle. As in the embodiments described above, the configuration of the conically-shaped valve head element 414 is selected to vary the size of the orifice 420 in relationship to the pressure differential created by fuel flow between chambers 442, 430.

Again, in the manner described, the vapor flow returning to the underground storage tank can be matched to the rate of flow of fuel drawn from the storage tank for delivery, e.g., through a fuel dispensing nozzle as described above having neither vapor flow nor vapor pressure regulation means. As a result, the possibility of collecting all of the hydrocarbon vapors as they are displaced from the vehicle tank and upward through the fill pipe towards the atmospheric opening is maximized by a precisely-matched flow arrangement.

Referring again to FIG. 9, the piston 412 is shown in close proximity to the slightly-conical surrounding wall surface 464 of flow adjusting sleeve 406. When a low flow, e.g., of approximately 1 gpm, occurs, the piston is forced to compress spring 424 to open passage 428 to permit flow. As flow increases, the piston 412 must compress spring 424 further to increase the flow area of passage 428 proportionately. The conical surface 464 is contoured to provide a nearly linear displacement of piston 412 with increasing gasoline flow. Spring 424 is selected to have compression performance characteristics that offer minimum resistance to flow while providing a force level that is high in comparison to the frictional resistance of the u-cup seal 426 acting to seal the rod-like extension 466 of vapor flow control valve 458. In this manner, the displacement of the vapor flow control valve 458 and piston 412 (dashed line position 412') match gasoline flow rate with a high degree of repeatability.

Flow adjusting sleeve 406 and vapor valve sleeve 410 are used to vary the operating conditions for the flow control device 400. If both adjusting sleeves 406, 410 are turned in their threaded engagement to housing 402, the initial compression on spring 424 is increased or decreased, depending on the direction of rotation. In this manner, the individual spring can be matched to a particular force requirement.

Movement of the flow adjusting sleeve 406 independently provides small adjustment to the relationship of liquid flow to vapor flow by opening or closing of passage 428 relative to the fixed at-rest position of piston 412. Each adjusting sleeve is provided with a locking jam nut 404 and 408 to positively secure the adjustments.

Moving the vapor valve sleeve 410 independently provides means for small adjustment to the amount of force required on piston 412 to unseal the vapor flow regulator valve o-ring 418 from valve seat 460.

What is claimed is:

1. In a fuel dispensing nozzle for delivering fuel into a fuel tank by way of a fill pipe, said nozzle comprising a nozzle body, a spout housing, a spout extending from said spout housing, a fuel conduit defined by said nozzle and leading to said spout, a vapor conduit defined by said nozzle, said vapor conduit associated with said spout for withdrawing displaced vapors from the fuel tank being filled and transporting them to a remote vapor collection system, a fuel valve for controlling flow of fuel through said fuel conduit, and a boot disposed about said spout and having a first closed end and a second open end, said second open end defined by a rim disposed for sealing engagement with a surface about a fuel tank fill pipe when said spout is inserted therein, said boot having a body portion defining a volume for receiving fuel vapor displaced from a fuel tank during delivery of fuel, said volume in communication with said vapor conduit, the improvement wherein said body portion of said boot comprises a transparent polymeric material, and said fuel dispensing nozzle further comprises a vapor regulator valve in said vapor conduit operable in response to a predetermined first vapor pressure condition in said nozzle body, said vapor regulator valve comprising a diaphragm mounted in said nozzle with a first surface facing said vapor conduit, said diaphragm blocking said vapor conduit in a first position and not blocking said vapor conduit in a second position, and biasing means urging said diaphragm to said second position, said diaphragm having a second surface facing a chamber, said nozzle further defining a vent linking said chamber with the ambient exterior of said nozzle, and vapor flow controlling means comprising a vapor flow control valve element disposed for movement within said vapor conduit relative to a valve seat defined by said conduit, a vapor flow orifice between said vapor flow control valve element and said valve seat having an area variable with the position of said vapor flow control valve element, and vapor flow control valve element positioning means comprising sealing means associated with said vapor flow control valve element, said sealing means having at least one surface exposed to fuel pressure in said fuel conduit.

2. The fuel dispensing nozzle of claim 1, wherein said transparent polymeric material of said boot is 80 (Shore A) durometer.

3. The fuel dispensing nozzle of claim 1, wherein said transparent polymeric material of said boot comprises polyurethane.

4. The fuel dispensing nozzle of claim 3, wherein said transparent polymeric material of said boot is 80 (Shore A) durometer.

5. In a fuel dispensing nozzle for delivering fuel into a fuel tank by way of a fill pipe, said nozzle comprising a nozzle body, a spout housing, a spout extending from said spout housing, a fuel conduit defined by said nozzle and leading to said spout, a vapor conduit defined by said nozzle, said vapor conduit associated with said spout for withdrawing displaced vapors from the fuel tank being filled and transporting them to a remote vapor collection system, a fuel valve for controlling flow of fuel through said fuel conduit, and means for connection of said vapor conduit to a source of uniform vacuum, and a boot disposed about said spout and having a first closed end and a second open end, said second open end defined by a rim disposed for sealing engagement with a surface about a fuel tank fill pipe when said spout is inserted therein, said boot having a body portion defining a volume for receiving fuel vapor displaced from a fuel tank during delivery of fuel, said volume in communication with said vapor conduit, the improvement wherein said body portion of said boot comprises a transparent polymeric material, and said fuel dispensing nozzle further comprises vapor flow controlling means comprising a vapor flow control valve element disposed for movement within said vapor conduit relative to a valve seat defined by said conduit, a vapor flow orifice between said vapor flow control valve element and said valve seat having an area variable with the position of said vapor flow control valve element, said control valve element having a generally tapering body with a first end diameter and a second end diameter relatively greater than said first end diameter, said control valve element oriented in said orifice with said first end diameter disposed upstream of said second end diameter, and said valve seat defined in a downstream region of said vapor flow orifice adjacent said second diameter end when said valve element is in closed position, and vapor flow control valve element positioning means comprising sealing means associated with said vapor flow control valve element, said sealing means having at least one surface exposed to fuel pressure in said fuel conduit.

6. The fuel dispensing nozzle of claim 5, wherein said transparent polymeric material of said boot is 80 (Shore A) durometer.

7. The fuel dispensing nozzle of claim 5, wherein said transparent polymeric material of said boot comprises polyurethane.

8. The fuel dispensing nozzle of claim 7, wherein said transparent polymeric material of said boot is 80 (Shore A) durometer.

* * * * *